United States Patent [19]

Bolomey

[11] Patent Number: 4,870,423

[45] Date of Patent: Sep. 26, 1989

[54] METHOD AND DEVICE FOR FOCUSING, ON ONE POINT TO BE EXAMINED, THE ANTENNAE OF AN ANTENNA ARRAY

[75] Inventor: Jean-Charles Bolomey, Paris, France

[73] Assignee: Centre National de la Recherche Scientifique French Public establishment, Paris, France

[21] Appl. No.: 36,479

[22] Filed: Apr. 9, 1987

[30] Foreign Application Priority Data

Apr. 11, 1986 [FR] France ..... 86 05205

[51] Int. Cl.[4] ..... H01Q 3/30

[52] U.S. Cl. ..... 342/368; 342/374

[58] Field of Search ..... 342/368, 374, 417, 754

[56] References Cited

U.S. PATENT DOCUMENTS*

| | | | |
|---|---|---|---|
| 3,140,490 | 7/1964 | Sichak et al. . | |
| 3,757,333 | 9/1973 | Procopio | 342/374 X |
| 3,806,931 | 4/1974 | Wright . | |
| 3,859,622 | 1/1975 | Hutchison et al. | 342/374 X |
| 3,878,520 | 4/1975 | Wright et al. . | |
| 3,993,999 | 11/1976 | Hemmi et al. | 342/374 X |
| 4,010,474 | 3/1977 | Provencher | 342/374 X |
| 4,028,702 | 6/1977 | Levine . | |
| 4,121,221 | 10/1978 | Meadows | 342/374 |
| 4,166,274 | 8/1979 | Rendink et al. . | |
| 4,186,398 | 1/1980 | Minnett et al. | 342/374 |
| 4,189,733 | 2/1980 | Malm | 342/368 |
| 4,190,818 | 2/1980 | Follin et al. | 342/368 X |
| 4,467,328 | 8/1984 | Hacker | 342/374 X |
| 4,620,193 | 10/1986 | Heeks | 342/368 X |
| 4,649,393 | 3/1987 | Rittenbach . | |
| 4,701,762 | 10/1987 | Apostolos . | |

FOREIGN PATENT DOCUMENTS 14650 8/1980 European Pat. Off. .

OTHER PUBLICATIONS

Hewlett-Packard Journal, vol. 34, No. 12, Dec. 1983; pp. 13-20, Amstelveen, NL: R. D. Gatske et al: "Electronic Scanner for a Phased-Array Ultrasound Transducer"-*pp. 16, 17, paragraph: A Mixing Scheme to Focus a Transducer Array Dynamically*.

*Primary Examiner*—Thomas H. Tarcza
*Assistant Examiner*—Mark Hellner
*Attorney, Agent, or Firm*—Stevens, Davis, Miller & Mosher

[57] ABSTRACT

A method and device are provided for focusing the antennae of an array on a point to be examined. Each microwave signal received by an array antenna is subjected to amplitude modulation by means of a phase shifted low frequency modulation signal. The modulated signals are summed and the result of the summation is subjected to microwave detection then to low frequency demodulation by means of the modulation signal. The focusing point depends on the phase law by which the modulation signal is phase shifted so as to obtain each phase shifted modulation signal.

21 Claims, 7 Drawing Sheets

METHOD AND DEVICE FOR FOCUSING, ON ONE POINT TO BE EXAMINED, THE ANTENNAE OF AN ANTENNA ARRAY

BACKGROUND OF THE INVENTION

1. Field of the Invention

The present invention relates first of all to a method for focusing, on at least one point to be examined of a microwave radiation source, the antennae of an antenna array receiving the radiation from the point with respective reception phase shifts.

Such a method is used when it is desired to obtain, from the microwave radiation coming from an object to be analysed, a microwave image of this object. For this, an antenna assembly is organized so as to form an array, this term being used in a sense close to, but wider than, that which it has in optics, and this antenna array is successively focused on each of the points to be examined of the object, so as to construct point by point the microwave image of this object. Microwave image forming systems have, in particular, applications in the biomedical field for the detection and treatment of tumours, for example, as well as in the civil engineering field, for detecting buried objects for example, or else for testing materials treated by microwave radiation (polymerization, defreezing, drying . . . ). Furthermore, the antennae known under the name of electronic sweep antennae, used for example in radar and telecommunications, are organized in the form of a fixed antenna array which has maximum sensitivity in a variable electronically controllable direction and use such a method corresponding to the focusing on a point situated at an infinite distance, and defined solely by its direction.

2. Description of the Prior Art

A focusing method is already known in which the signal received by each antenna is phase shifted in a microwave phase shifter, the phase shifted signals being added and the summation signal being subjected to microwave detection. The phase law which determines the particular phase shift to be applied to each signal to be received is established so that the contributions from the point on which the array is focused are in phase at the time of summing, the contributions coming from other points having any phases with respect to each other. Thus, after summation, the signal obtained represents principally the contribution of the focusing point.

Now, this known method has the drawback of being difficult to implement from a practical point of view, for it requires the use of as many microwave phase shifters as there are antennae in the array. Now, a microwave phase shifter is a relatively complex component, of a high cost price and requiring considerable space. In the cases where the number of antennae reach several hundreds, even several thousands, this solution is therefore very expensive. In addition, it is clear that the space required by the phase shifters conditions the distance between an antenna and the adjacent antennae, that is to say the pitch of the array. Now, an antenna with too large a pitch will give an image of poor quality. Another drawback of this method is that it does not allow simultaneous focusing on several points at a given time.

To overcome these drawbacks, the use of a synthetic focusing method is known. In such a method, each signal received is not phase shifted but is subjected directly to coherent microwave detection, that is to say detection for knowing the modulus and phase of the detected signal. The modulus and phase of each signal received are then acquired by a computer. The computer carries out digital processing of the set of such data, so as to extract therefrom the contribution coming from any point of the object. Such processing is then tantamount to synthetic focusing as opposed to analog focusing obtained by using microwave phase shifters.

The synthetic focusing method has however the following drawbacks:

the signal to noise ratio is very much less than the signal to noise ratio of the analog focusing method;

the only digital processing algorithms which it is possible to use only correspond to particular array geometries and in a limited number (plane, cylindrical, spherical geometry . . . );

the practical implementation of the method, which requires as many successive coherent microwave detections as there are antennae, involves the use of a microwave multiplexer with a very large number of channels, so of a high cost price and requiring considerable space;

the coherent detections carried out on each signal make the processing of incoherent signals impossible, that is to say signals whose phase varies in a random fashion, such as the microwave signals emitted by the object itself used for example in thermography for obtaining an image of the temperature of the different points of the object;

simultaneous focusing on several points requires the use of as many computers as there are focusing points.

To overcome the drawbacks of the known methods the applicant has sought an analog type focusing method which may be adapted to any array geometry, but not requiring the use of microwave phase shifters as in the only known analog focusing method. For this, the applicant had the idea of carrying out the phase shifts not on the microwave signals but on a low frequency signal.

SUMMARY OF THE INVENTION

The invention, which was perfected in the Laboratoire des Signaux et Systemes de l'Ecole Supérieure d'Electricité, "unité mixte 14" of the Centre National de la Recherche Scientifique, there provides a method of focusing, on at least one point to be examined, of a microwave radiating source, antennae of an antenna array receiving the radiation from the point with respective phase shifts, wherein:

the signals delivered by the antennae are modulated in amplitude by at least the same low frequency modulation signal, respectively with modulation phase shifts corresponding to the reception phase shifts, the modulated signals are added into a summation signal, the microwave component of the summation signal is detected, and the detected signal is demodulated.

The method of the invention uses no microwave phase shifter. It is the low frequency modulation signal which is phase shifted in low frequency phase shifters, moreover very simple. This result is obtained by modulating in amplitude the signals delivered by antennae. Now, as will be discussed further on, space saving and inexpensive microwave modulators may be used.

Since the method of the invention is an analog type method, it may be adapted to non conventional array geometries, it allows irregularities in the alignment of the antennae of the array to be compensated, for example, it has a better signal to noise ratio than the synthetic focusing method and it can be adapted to incoherent radiation.

Advantageously, the signals delivered by the antennae are amplitude modulated by a low frequency square type modulation signal, with modulation phase shifts.

In this case, the modulation may be provided by means of microwave switches, of the PIN diode type for example, so of a low cost price and taking up less space.

The invention also relates to a device for implementing the method of the invention, including:

means for generating a low frequency signal, means for phase shifting the low frequency signal by phase shifts corresponding to the reception phase shifts, delivering low frequency phase shifted signals, means for modulating in amplitude the signals delivered by the antenna, by said low frequency phase shifted signals, respectively, means for adding the modulated signals, delivering a summation signal, means for detecting the microwave component of the summation signal, delivering a detected signal, and, means for demodulating the detected signal.

Naturally, and as will be seen in the description, the invention may also be used for focusing the antennae of a transmitting antenna array.

BRIEF DESCRIPTION OF THE DRAWINGS

The present invention will be better understood from the following description of several ways of putting the method of the invention into practice and several embodiments of the device of the invention, with reference to the accompanying drawings in which.

DESCRIPTION OF THE PREFERRED EMBODIMENTS

Figure 1:
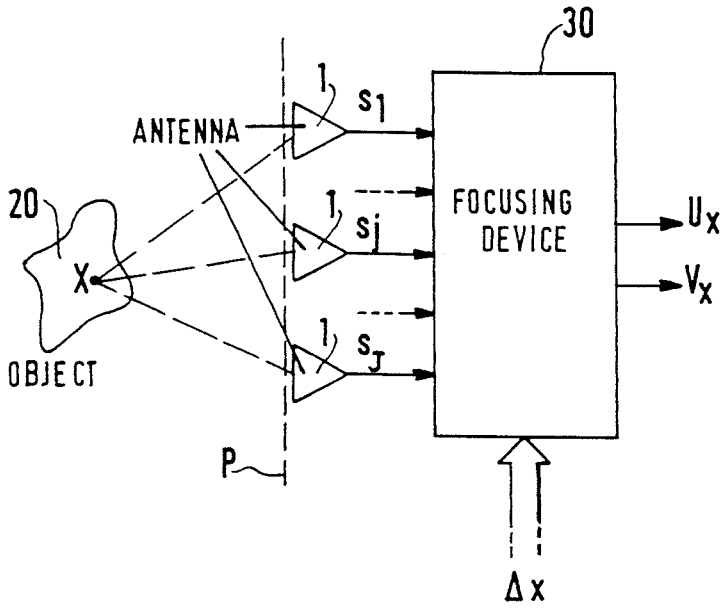
FIG. 1 shows a block diagram of a reception antenna array and a focusing device of the invention.

Referring to FIG. 1, in order to obtain a microwave image of an object 20, a series of J antennae 1 are disposed on a surface, here a plane P, exposed to microwave electromagnetic radiation coming from the object 20. The antenna 1 of rank j receives a microwave signal $s_j$. A focusing device 30 is provided with j inputs receiving the J signals $s_1, \ldots s_j, \ldots$, and $s_J$. It is also provided with two outputs delivering two useful signals $U_X$ and $V_X$, as well as a control input receiving, here by means of a parallel bus, a control signal $\Delta_X$.

The object 20 may itself be the source of radiation received by the antennae 1, or it may act as secondary source, that is to say as reflector of radiation emitted by a primary microwave source, for illuminating the object 20, and not shown in FIG. 1 for the sake of simplicity. It will be considered in what follows, unless otherwise mentioned, that the microwave radiation received by the antennae 1 is monochromatic of frequency f, either because the radiation source is itself monochromatic of frequency f, or because, with the source emitting radiation in a certain frequency band, a selective focusing device 30 is used centered on the frequency f.

The series of J antennae 1 disposed regularly in the plane P is called, by analogy with the arrays met with in optics, antenna array. The microwave image is obtained by successively focusing the antenna network 1 on each of the points to be examined X of the object 20, during sequential scanning of this object point by point.

By focusing the antennae 1 of the antenna network on a point X, the focusing device 30 is controlled by means of the control signal $\Delta_X$ so that the useful signals $U_X$ and $V_X$ at the output of the device are representative only of the microwave radiation coming from point X.

A sequential scanning device, not shown, generates the successive control signals $\Delta_X$ and a display device, not shown, synchronized by the sequential scanning device collects the signals $U_X$ and $V_X$. The sequential scanning device and the display device are of the conventional type used in known image formation systems.

Before describing the focusing device 30 of the invention, it is useful to state the principle of the methods of the prior art.

In these methods, each signal $s_j$ is caused to undergo a microwave phase shift of a given angle $\Delta_X(j)$, and the J phase shifted signals are summed. The law $\Delta_X(j)$ which determines the phase shift angle for each signal $s_j$, called phase law for the point X, is established so that the contributions from point X, in phase at the time of summing, interfere constructively, whereas the contributions from the other points, with any phases with respect to each other, interfere destructively. Thus, the result of summing represents mainly the contribution from point X. Thus the antenna array 1 is focused on point X while imposing the phase law $\Delta_X(j)$ by means of the signal $\Delta_X$. The phase law $\Delta_X(j)$ may be derived from the knowledge of the lengths of the paths joining point X to each of the antennae 1.

The focusing device 30 of the invention will now be described with reference to FIG. 2. In this Figure, each reference 2 designates a microwave switch. As many switches 2 are provided as there are inputs, that is to say here J switches.

Switch 2 of rank j is provided with a microwave input receiving the signal $s_j$ and a microwave output delivering the signal $s'_j$, as well as a control input receiving a signal $C_j$.

A microwave summator 3 is provided with J inputs receiving the J signals $s'_1, \ldots s'_j, \ldots$ and $s'_J$, and an output delivering a signal s.

A coherent microwave detection circuit 6 is provided with a signal input receiving the signal s, a control input and two outputs delivering signals DA and DB.

A microwave oscillator 4 is provided with an output delivering a coherent microwave detection signal r connected to the control input of circuit 6. Signal r is a sinusoidal signal of frequency f.

A coherent low frequency detection circuit 8 is provided with two signal inputs receiving the signals DA and DB, a control input and two outputs delivering the signals $U_X$ and $V_X$.

A low frequency oscillator 11 is provided with an output delivering a modulation signal D, connected to the control input of circuit 8.

The signal D is a sinusoidal signal of frequency F, of a value included between substantially a few, kilohertz and substantially a few megahertz.

A phase shift circuit 12 is provided with an input receiving the signal D, J control inputs connected to the parallel bus receiving the control signal $\Delta_X$ and J outputs delivering the J signals $C_l, \ldots, C_j, \ldots$ and $C_J$.

Figure 3:
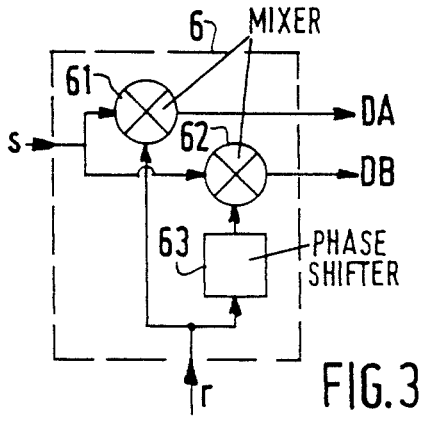
FIG. 3 shows a detailed diagram of the coherent microwave detection circuit of FIG. 2.

Referring to FIG. 3, the coherent microwave detection circuit 6 includes two mixers 61 and 62 and a phase shifter 63. The mixers 61 and 62 are of the type having two inputs, and an output delivering a signal equal at all times to the product of the signals received at the two inputs. These are devices known by a man skilled in the art under the name of ring modulators or balanced mixers.

Mixer 61 receives at one input the signal s and at the other input the signal r and outputs the signal DA.

Mixer 62 receives at one input the signal s and at the other input the signal r phase shifted by an angle equal to $\pi/2$ in the phase shifter 63. Mixer 62 outputs the signal DB.

Figure 4:
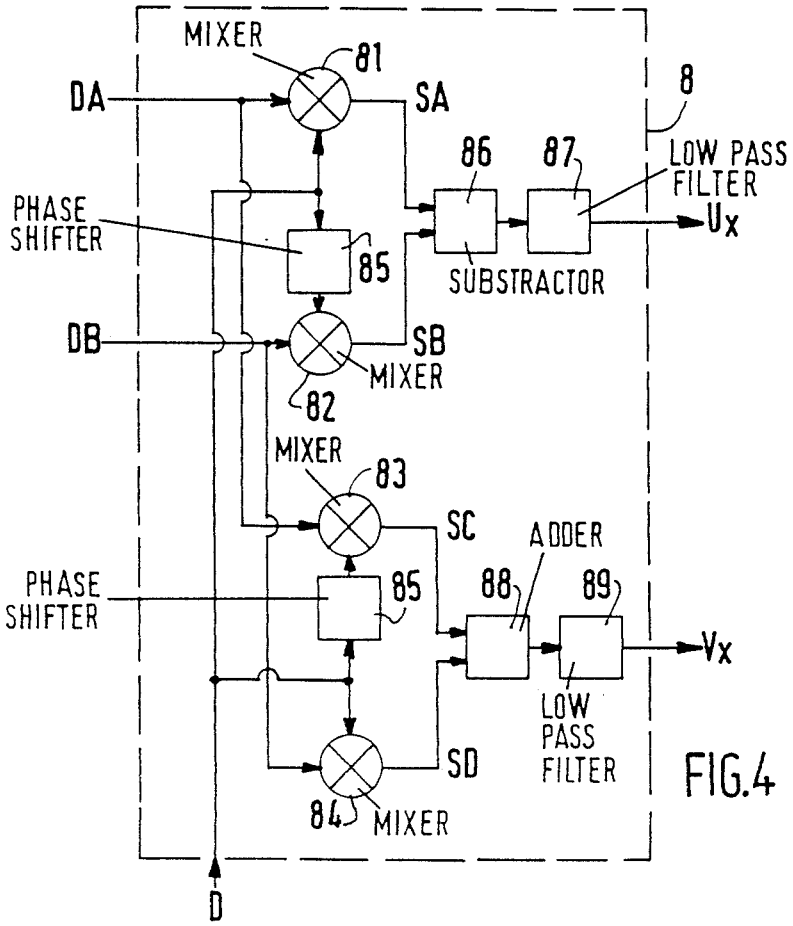
FIG. 4 shows a detailed diagram of the coherent low frequency detection circuit of FIG. 2.

Referring to FIG. 4, the coherent low frequency detection circuit 8 includes four mixers 81, 82, 83 and 84, two phase shifters 85 and 85', a subtractor 86 and an adder 88, and two low pass filters 87 and 89.

The mixers 81 to 84 are of a type comparable to that of mixers 61 and 62. Mixer 81 receives at one input the signal DA and at the other input the signal D and it outputs a signal SA. Mixer 82 receives at one input the signal DB and at the other input the signal D phase shifted by an angle equal to $\pi/2$ in phase shifter 85 and it outputs the signal SB. Mixer 83 receives at one input the signal DA and at the other input the signal D phase shifted by an angle equal to $\pi/2$ in phase shifter 85' and it outputs the signal SC. Mixer 84 receives at one input the signal DB and at the other input the signal D and it outputs the signal SD.

Subtractor 86 recieves at both its inputs the signals SA and SB; its output is connected to the filter 87 which outputs the signal $U_X$.

The adder 88 receives at both its inputs the signals SC and SD; its output is connected to the filter 89 which outputs the signal $V_X$.

Figure 5:
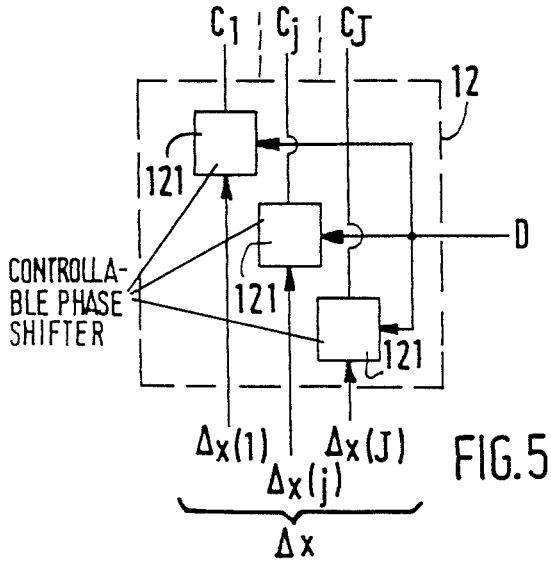
FIG. 5 shows a detailed diagram of the phase shift circuit of FIG. 2.

Referring to FIG. 5, the phase shift circuit 12 includes J controllable phase shifters 121. Phase shifter 121 of rank J is provided with a signal input receiving the signal D, a control input controlling the phase shift angle $\Delta_X(j)$, receiving a control signal also called $\Delta_X(j)$ for the sake of simplicity, and a signal output delivering the signal $C_j$, phase shifted by the angle $\Delta_X(j)$ with respect to the modulation signal D.

The J control inputs of the J phase shifters 121 form the parallel bus to which is applied the signal $\Delta_X$ formed of J signals $\Delta_X(j)$.

The switches 2 are here PIN diode switches, well known to a man skilled in the art.

The summator 3 and mixers 61 and 62 are circuits of the type known by a man skilled in the art for microwave use, whereas mixers 81 to 84, subtractor 86 and adder 88, the low pass filters 87 and 89 and phase shifters 121 are circuits of the type known by a man skilled in the art for low frequency use.

The operation of the focusing device 30 which has just been described will now be explained with reference to FIG. 10.

It is assumed that the signal r, not shown, of frequency f, delivered by the microwave oscillator 4 is of the form $$r=\cos(2\pi ft)$$

and that the signal D of frequency F, delivered by oscillator 11, is of the form $$D=\cos(2\pi Ft)$$

Signal $C_j$ at the output of phase shifter 121 of rank j is then equal to $$C_j=\cos(2\pi Ft+\Delta_X(j))$$

Let us now suppose that the microwave signal received by the antenna of rank j is of the form:

$$s_j=A_j\cos(2\pi ft+\delta_j)$$

in which expression $A_j$ is the amplitude of the signal $s_j$ and $\delta_j$ its phase angle with respect to the signal r.

Then the signal $s'_j$ at the output of switch 2 or rank j is written:

$$s'_j=s_j.Ech[C_j]$$

in this expression, the step function Ech $[C_j]$ is equal to 1 if $C_j$ is positive and equal to 0 if $C_j$ is negative.

Figure 10:
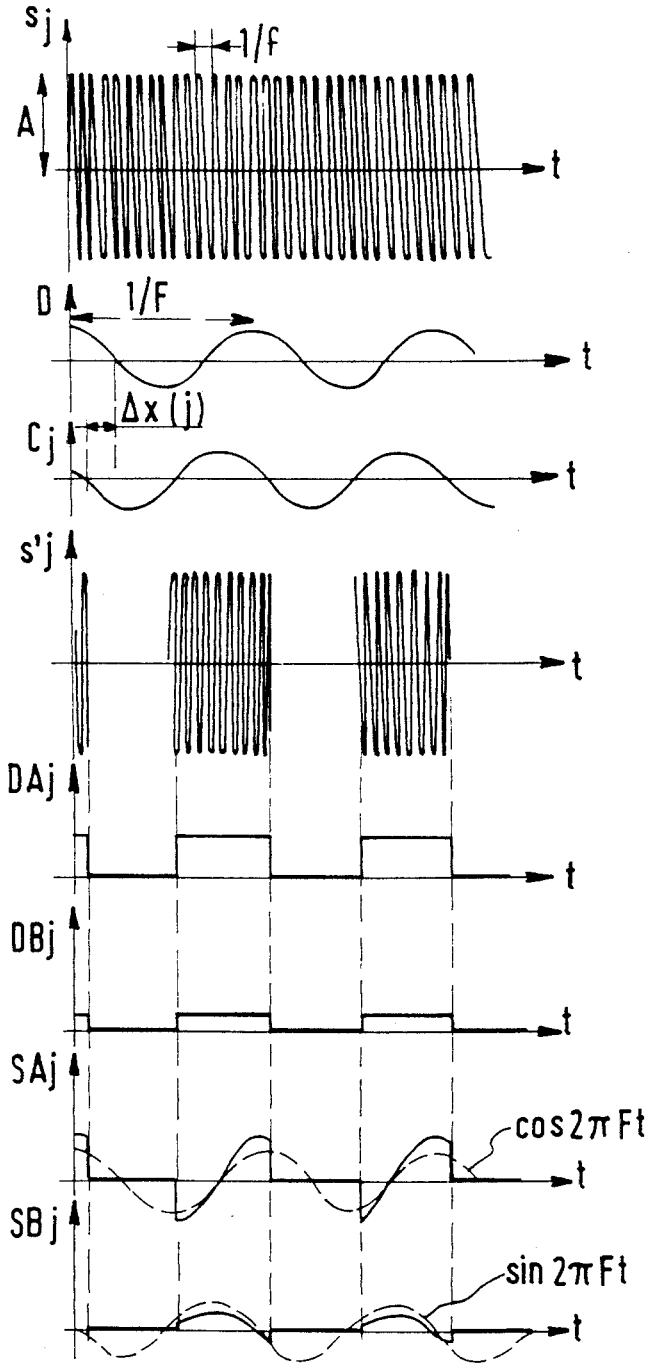
FIG. 10 shows a timing diagram of the signals of the focusing device of FIG. 2.

Thus, we may say that the signal $s'_j$ is amplitude modulated by a square type modulation signal, as shown in FIG. 10.

The product of signal r multiplied by the component $s'_j$ of signal s, accomplished in the coherent microwave detection circuit 6 by mixer 61, gives a signal:

$$r.s'_j=\cos(2\pi ft).A_j\cos(2\pi ft+\delta_j).Ech[C_j]$$

that is to say:

$$r.s'_j=A_j/2.[\cos(4\pi ft+\delta_j)+\cos(\delta_j)].Ech[C_j]$$

The first component of this signal, at frequency 2f, is here filtered by the mixer 61. If that were not the case, a low pass filter would eliminate this component. Thus, the contribution $DA_j$ of this signal $s_j$ of the signal DA at the output of the coherent microwave detection circuit 6 is equal to:

$$DA_j=A_j/2.\cos\delta_j.Ech[C_j]$$

For the same reasons, and considering the phase shift $\pi/2$ introduced by the phase shifter 63, the contribution $DB_j$ of the signal $s_j$ to the signal DB at the output of the coherent microwave detection circuit is equal to:

$$DB_j=A_j/2.\sin\delta_j.Ech[C_j]$$

In the coherent low frequency detection circuit 8, the contributions $SA_j$, $SB_j$, $SC_j$ and $SD_j$ (these latter two not shown for the sake of simplicity) of the signal s to the signal SA, SB, SC and SD are equal to:

$$SA_j=A_j/2.\cos\delta_j.Ech[C_j].\cos(2\pi Ft)$$

$$SB_j=A_j/2.\sin\delta_j.Ech[C_j].\cos(2\pi Ft+(\pi/2)$$

$$SC_j=A_j/2.\cos\delta_j.Ech[C_j].\cos(2\pi Ft+(\pi/2)$$

$$SD_j = A_j/2.\sin\delta_j Ech[C_j].\cos(2\pi Ft)$$

Now, the function Ech $[C_j]$ may be broken down into a fundamental:

$$(1/\pi)\cos(2\pi Ft + \Delta_X(j))$$

and harmonics.

Only the fundamental, multiplied by the signal D, phase shifted by $\pi/2$ or not, will give rise to a continuous or slowly variable component.

Thus, after passing through the subtractor 86 and the adder 88 and after low pass filtering in filters 88 and 89, the contributions $U_{Xj}$ and $V_{Xj}$ of the signal $s_j$ to the signals $U_X$ and $V_X$ are written:

$$U_{Xj} = A_j/4\pi[\cos\delta_j.\cos(\Delta_X(j)) - \sin\delta_j.\sin(\Delta_X(j))]$$

$$V_{Xj} = A_j/4\pi[\cos\delta_j.\sin(\Delta_X(j)) + \sin\delta_j.\cos(\Delta_X(j))]$$

that is to say:

$$U_{Xj} = A_j/4\pi.\cos[\delta_j + \Delta_X(j)]$$

$$V_{Xj} = A_j/4\pi.\sin[\delta_j + \Delta_X(j)]$$

It is apparent that the phase shift $\Delta_X(j)$ of the modulation signal is added to the phase shift $\delta_j$ of the microwave signal. Therefore, everything happens as if the signal $s_j$ were phase shifted by an angle $\Delta_X(j)$ in a microwave phase shifter. Thus, if a phase law is chosen so that the angle $\Delta_X(j)$ corresponds to the angle $\delta_j$ so that their sum remains constant whatever j, the signals $U_X$ and $V_X$, equal to the sum of all the $U_{Xj}$ and $V_{Xj}$ respectively, are clearly representative of the radiation emitted by the focusing point X.

Figure 6:
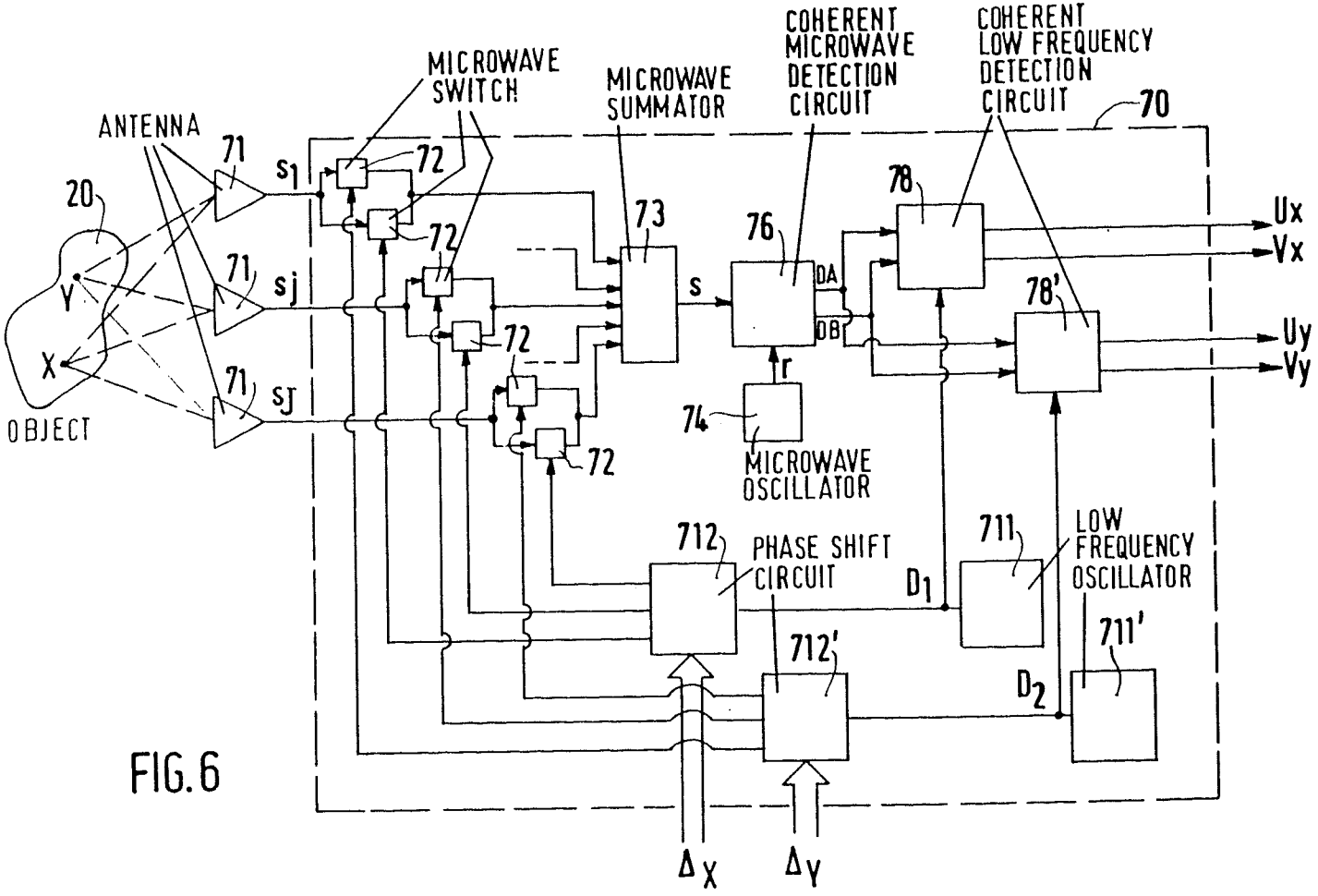
FIG. 6 shows a device for simultaneously focusing on two points of the antennae of a reception antenna array.

The focusing device 70 shown in FIG. 6 allows simultaneous focusing on two points X and Y of object 20, so as to observe continuously what is happening at these two particular points without having to form a complete image, for example for following the evolution of their temperature in certain biomedical applications.

For this, the focusing device 70 is provided with two buses receiving the signals $\Delta_X$ and $\Delta_Y$ representative of the phase laws $\Delta_X(j)$ and $\Delta_Y(j)$ corresponding to the points X and Y to be observed. The focusing device 70 is also provided with two groups of two outputs continuously delivering signals representative of points X and Y, here for example the previously defined signals $U_X$, $V_X$, $U_Y$ and $V_Y$.

Figure 2:
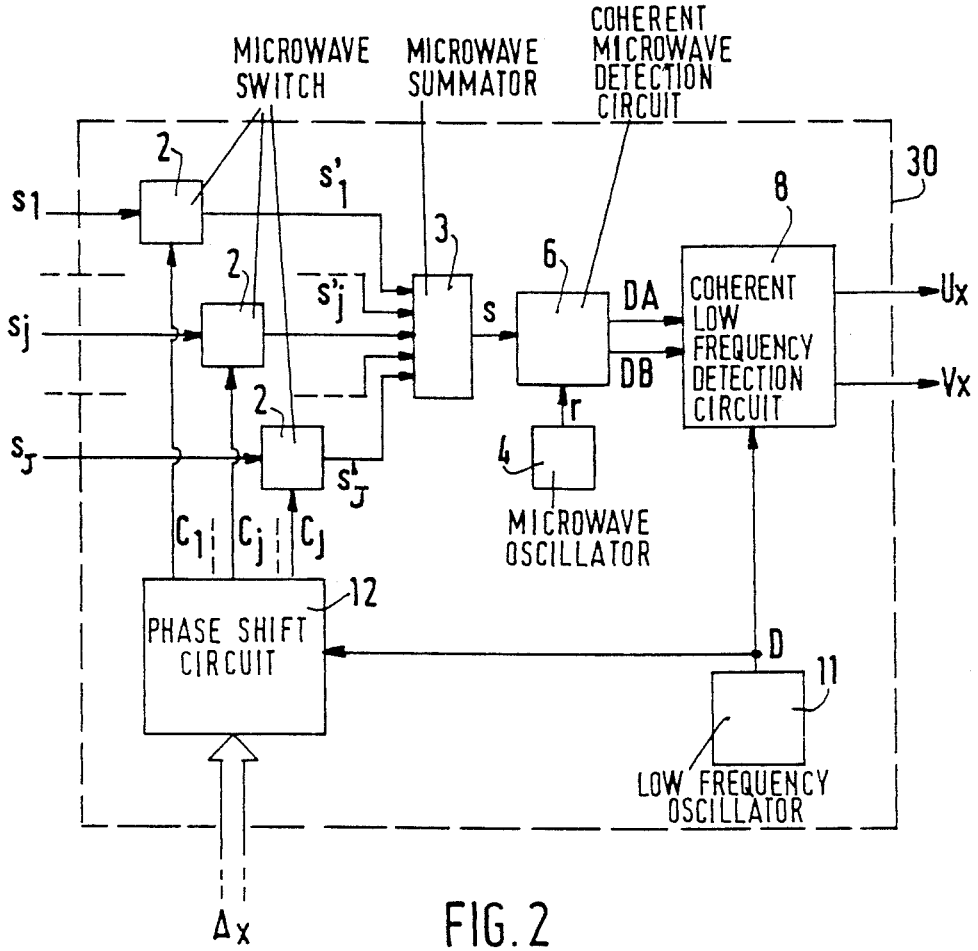
FIG. 2 shows a detailed diagram of the focusing device of FIG. 1.

The focusing device 70 is distinguished from the device 30 of FIG. 2 essentially in that it includes two oscillators 711 and 711' delivering two signals $D_l$ and $D_2$ respectively, of frequency $F_l$ and $F_2$ respectively. The two signals $D_l$ and $D_2$ are of the same type as the signal D already met.

The output signal from oscillator 711 is applied to a phase shift circuit 712 similar to circuit 12 of FIG. 2. Circuit 712 is controlled by the signal $\Delta_X$.

Similarly, the output signal of oscillator 711' is applied to a phase shift circuit 712' similar to circuit 12 of FIG. 2, controlled by the signal $\Delta_Y$.

Each circuit 712 and 712' delivers a set of J modulation signals similar to the signals $C_l, \ldots C_j \ldots$, and $C_J$ of the FIG. 2. The two modulation signals of rank j control two switches 72 mounted in parallel downstream of an antenna 71, of rank j. The switches 72, 2J in number, and the antennae 71, J in number, are similar to the switches 2 and to the antennae 1 of FIG. 2.

The J output signals of the J groups of two parallel switches 72 are added in a microwave summator 73, which delivers a signal s.

A coherent microwave detection circuit 76, similar to circuit 6 in FIG. 3, receives the signal s at its signal input and delivers two signals DA and DB at its two outputs.

A microwave oscillator 74, similar to oscillator 4 of FIG. 2, delivers a signal r to the control input of circuit 76.

Two coherent low frequency detection circuits 78 and 78' are provided, similar to circuit 8 of FIG. 4. Each circuit 78 and 78' receives the signals DA and DB at its two signal inputs, and at its control input the signal $D_l$ and the signal $D_2$ respectively.

Circuit 78 outputs the signals $U_X$ and $Y_X$ and circuit 78' the signals $U_Y$ and $V_Y$.

The operation of the focusing device 70 is as follows. Because the frequencies $F_l$ and $F_2$ of the signals $D_l$ and $D_2$ are different, the coherent low frequency detection circuit 78 demodulates only the components of signals DA and DB modulated at frequency $F_l$ in the switches 72, that is to say those which correspond to the phase law $\Delta_X$, determined by the phase shift circuit 712, focusing the array on point X. For the same reason, circuit 78' demodulates only the components of signals DA and DB modulated at the frequency $F_2$, that is to say those which correspond to the phase shift law $\Delta_Y$, focusing the array on point Y.

Naturally, it is possible to extend the focusing device which has just been described to the simultaneous focusing on a number of points greater than two, by choosing the different modulation frequencies so as to avoid any risk of intermodulation.

Naturally, the focusing method of the invention may be extended to image forming systems in which a focused antenna array is used for illuminating a point of the object to be observed and a non focused antenna array, or else a single omnidirection antenna, for receiving the radiation coming from the illuminated point.

Figure 7:
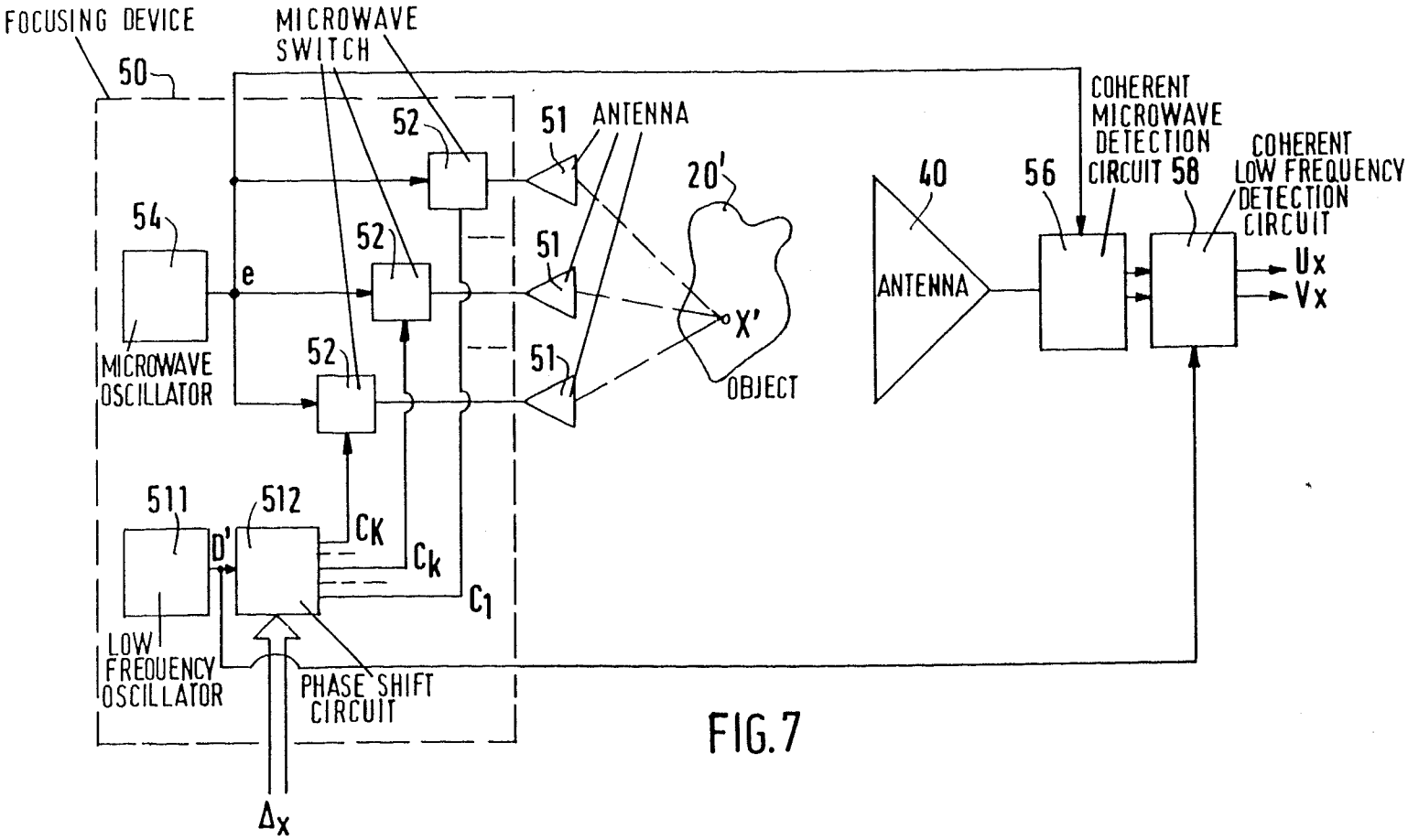
FIG. 7 shows a device for focusing the antenna of a transmitting antenna array.

FIG. 7 shows a device for putting such a method into practice. Block 50 shows the focusing device of an array of K transmitting antennae 51 to be focused on the point X' of object 20'.

The focusing device 50 includes a microwave oscillator 54, delivering a microwave transmission signal e of frequency f.

Each antenna 51 is connected to the output of the oscillator 54 through a microwave switch 52, of the same type as the switches 2 of FIG. 2. Switch 52 of rank k is provided with a control input receiving a signal $C_k$.

A phase shift circuit 512, similar to the phase shift circuit 12 of FIG. 5, is provided with a signal input and K outputs delivering the signals $C_l, \ldots C_k, \ldots$, and $C_K$, each signal $C_k$ being phase shifted with respect to the signal received at the input of circuit 512 by an angle $\Delta_X(k)$ controlled by the signal $\Delta_X$ applied to the control bus of block 512.

An oscillator 511, similar to the oscillator 11 of FIG. 2, delivers a modulation signal D' of frequency F, to the input of block 512.

On reception, a reception antenna 40, here the only one, picks up the signals coming from the object 20'. It is followed by a coherent microwave detection circuit 56, similar to circuit 6 of FIG. 3. Circuit 56 receives, at its control input, the output signal of oscillator 54. The two outputs of circuit 56 are connected to a coherent detection circuit 58, similar to circuit 8 of FIG. 4. The control input of circuit 58 receives the modulation signal D'. Circuit 58 outputs the signals $U_X$ and $V_X$.

The operation of the focusing device 50 is similar to that of device 30. The phase shifts $\Delta_X(k)$ introduced in the modulation signals of the microwave signals emitted produce the same effect on the signal received and subjected to the coherent microwave detection at frequency f, in circuit 56, and to the coherent low frequency detection at frequency F in circuit 58, as phase shifts $\Delta_X(k)$ introduced in the microwave signals emitted. If these phase shifts $\Delta_X(k)$ are chosen to correspond to the phasing, at point X of the signals from the K antennae 51, the transmission network has then been focused on point X.

Obviously, it is possible to use simultaneously a transmission array focused by means of switches controlled at frequency $F_E$ and a reception array focused by means of switches controlled at frequency $F_R$. Under these conditions, two successive low frequency coherent detections must be carried out, one at frequency $F_E$, the other at frequency $F_R$. Since these coherent detections are followed by low pass filtering so as to keep only the low part of the frequency spectrum of the output signals, it is equivalent to carrying out a single coherent low frequency detection at the beat frequency $F_B$ between $F_E$ and $F_R$, namely:

$$F_B = |F_E - F_R|$$

Such a situation is met with for example in image forming systems using crossed linear arrays. In such systems, instead of flat arrays, linear arrays are used, the direction of the transmitting array being perpendicular for example to the direction of the reception array. These crossed linear arrays are well known to a man skilled in the art for their better longitudinal spatial resolution and the reduced number of antennae used.

Obviously, it is possible with the method of the invention to focus simultaneously the antenna of a transmitting array on several points, by using the device 70 of FIG. 6 to the transmission side.

In the preceding description, it has been implicitly considered, in the case for example of a reception antenna array, that the output of each antenna was a microwave signal guided by a guide structure of the wave guide, coaxial cable or strip line type, for example. In this case, the summation is accomplished by a microwave summator, like the summator 3 of FIG. 2, having J input accesses and an output access, each access being connectable to a guide structure of the above defined type.

Figure 8:
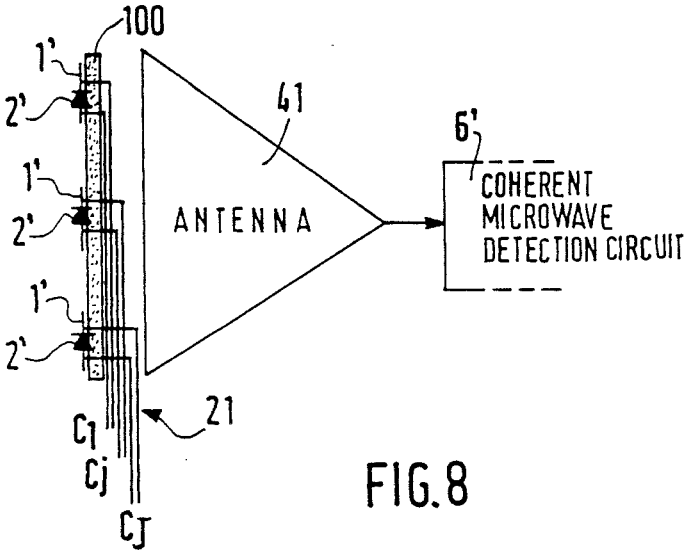
FIG. 8 shows a first variant of the focusing device of FIG. 2.

This is not obligatory, and FIG. 8 shows for example a device in which the reception antennae are dipole antennae 1', arranged with even spacing on an insulating material panel 100. Panel 100 is disposed in front of a single antenna 41, which plays the role of summator of the microwave signals picked up and radiated again by the antennae 1', these signals being no longer supported as before by a guide structure. In this case, the switches may be simple diodes 2', the switching signals $C_l, \ldots C_j, \ldots$ and $C_J$ being for example applied through connections 21 which cause little disturbance to the electromagnetic field. In a known way, such connections are formed, for example from carbon threads so as to be sufficiently resistive and have only a small influence on the electromagnetic field. If photoconducting diodes 2' are used switched by means of light signals applied for example by means of a laser beam, the connections 21 may be omitted.

Antenna 41, playing the role of summator, is connected directly to a coherent microwave detection circuit, identical to circuit 6 of FIG. 2, in the case of a reception antenna array. The rest of the device being unchanged.

To reduce the number of mixers used in the device 30 of FIG. 2, instead of having each mixer carrying out the same task permanently, they can carry out different tasks in time. Thus, the focusing device 90 of FIG. 9 shows a variant of the device of the invention, using only two mixers instead of six.

Figure 9:
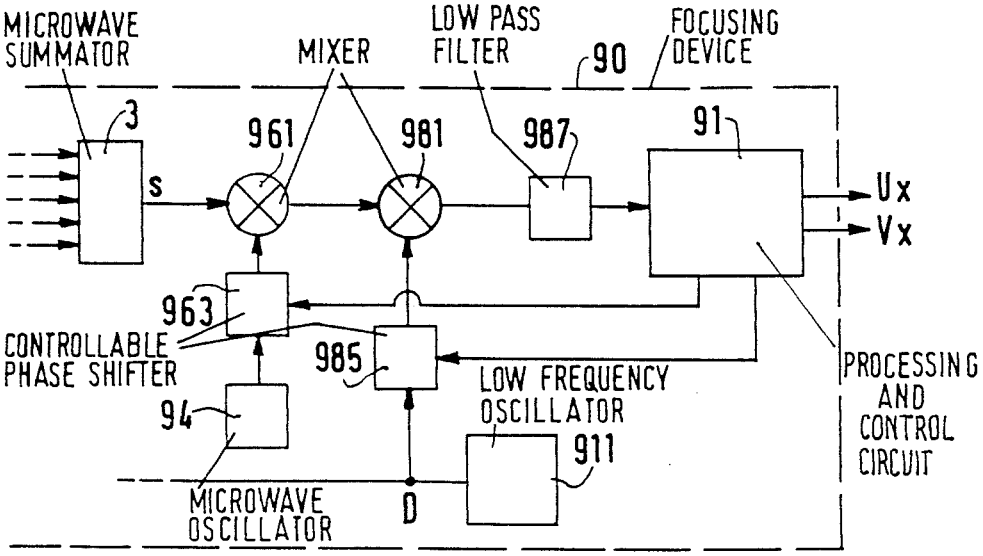
FIG. 9 shows a second variant of the focusing device of FIG. 2.

Referring then to FIG. 9, a mixer 961, identical to mixer 61 of FIG. 3, is provided with a first input receiving the output signal s of summator 3, a second input and an output.

A mixer 981 identical to mixer 81 of FIG. 4 is provided with a first input connected to the output of mixer 961, a second input and an output connected to the input of a low pass filter 987, identical to the low pass filter 87 of FIG. 4.

The output of an oscillator 94, identical to oscillator 4 of FIG. 2, is connected to the second input of mixer 961 through a controllable phase shifter 963. The output of oscillator 911, identical to oscillator 11 of FIG. 2, is connected to the second input of mixer 981 through a controllable phase shifter 985.

The controllable phase shifters 963 and 985 are operable to phase shift by an angle equal to 0, or equal to $\pi/2$, depending on a signal applied to the control input with which each of them is provided.

A processing and control circuit 91, for example with a microprocessor, and having two outputs connected to the control inputs of phase shifters 963 and 985, an input connected to the output of the low pass filter 987 and two outputs delivering the signals $U_X$ and $V_X$.

The operation of the focusing device 90 is as follows: the processing and control circuit 91 controls the phase shifters 963 and 985 sequentially, so that the signals SA, SB, SC and SD defined above appear one after the other at the input of filter 987. The circuit 91 stores the different filtered signals and processes the corresponding data for adding it and delivering the above defined signals $U_X$ and $V_X$.

In the preceding description, the case has always been considered in which the signals picked up are coherent signals, that is to say periodic signals of defined phase, to which a coherent microwave detection may be applied, as in the circuits 6, 76, 6' and 961–63, depending on the case. The invention is not limited to such coherent radiation and may also be applied to thermography for example.

In this case, an image is constructed representative of the temperatures of the different points of the object, from microwave signals whose object is itself the source. Since these signals are incoherent, that is to say of random phase, they must be detected with special detection devices of known type, for example quadratic detection devices with or without previous frequency changes. The devices of FIGS. 2, 6, 8 and 9 must then be modified, in this case, so that the coherent microwave detection circuits 6, 76, 6' and 961–963 are replaced by adequate devices.

Finally, in all that has gone before, it has been considered that the microwave signals emitted or picked up were subjected to an all or nothing amplitude modulation by means of switches placed in a microwave channel. It is clear that this solution is materially the simplest to put into practice. Such all or nothing modulation is equivalent to one produced by a modulation signal of square signal type. The spectrum of such a signal is formed of a fundamental component and harmonics. Now, as we have seen, considering the low pass filtering carried out at the end of the chain, the influence of the harmonics is nul. The same result then would be obtained, except for a level factor, by replacing the microwave switches 2 by product modulators, for example ring modulators, controlled by the signals $C_l$, . . . $C_j$, . . . and $C_J$.

The device 70 for simultaneous focusing on several points of FIG. 6 could then be modified by placing only a single modulator downstream of each antenna, and by controlling this modulator with the sum of the two corresponding signals from the phase shift circuits 712 and 712'.

In the preceding description, the antennae are generally organized on a surface so as to form an array. Naturally, this is not obligatory and, as was moreover mentioned for the crossed arrays, the antennae can be organized in a straight or curved line so as to form a line array.

In the case of simultaneous focusing on several points, it is not obligatory to use as many parallel switches in each channel as there are focusing points. A single switch may be used controlled by a suitable signal, for example the signal resulting from the product of the step functions relative to each of the phase shifted modulation signals.

What is claimed is:

1. A method for focusing, on at least one point to be examined of a microwave radiating source, individual antenna elements of an antenna array receiving the radiation from the point with respective reception phase shifts, comprising the steps of:

amplitude modulating signals delivered by each individual antenna element by at least the same low frequency modulation signal, the low frequency modulation signal being phase shifted for each antenna element by an amount corresponding to the reception phase shift seen by each antenna element, adding the amplitude modulated signals to form a summation signal, detecting the microwave component of the summation signal, and demodulating the detected signal.

2. The method as claimed in claim 1, wherein said signals delivered by each antenna element are amplitude modulated by a low frequency square-wave modulation signal which is phase shifted for each of said antenna elements.

3. The method as claimed in claim 1, wherein each phase shift of said modulation signal for a respective antenna element corresponds to each phase shift of a signal delivered by that antenna element so that the sum of the phase shifts is the same for each antenna element.

4. The method as claimed in claim 2, wherein each phase shift of said modulation signal for a respective antenna element corresponds to each phase shift of a signal delivered by that antenna element so that the sum of the phase shifts is the same for each antenna element.

5. The method as claimed in claim 1, wherein the step of demodulating the detected signal comprises multiplying the detected signal by the modulation signal, multiplying the detected signal by the modulation signal phase shifted by $\pi/2$, and low pass filtering the multiplied detected signal.

6. The method as claimed in claim 2, wherein the step of demodulating the detected signal comprises multiplying the detected signal by the modulation signal, multiplying the detected signal by the modulation signal phase shifted by $\pi/2$, and low pass filtering the multiplied detected signal.

7. The method as claimed in claim 3, wherein the step of demodulating the detected signal comprises multiplying the detected signal by the modulation signal, multiplying the detected signal by the modulation signal phase shifted by $\pi/2$, and low pass filtering the multiplied detected signal.

8. The method as claimed in claim 1, wherein the step of detecting the microwave component of the summation signal comprises multiplying the summation signal by a microwave detection signal, multiplying the summation signal by the microwave detection signal phase shifted by $\pi/2$, and low pass filtering the multiplied summation signal.

9. The method as claimed in claim 2, wherein the step of detecting the microwave component of the summation signal comprises multiplying the summation signal by a microwave detection signal, multiplying the summation signal by the microwave detection signal phase shifted by $\pi/2$, and low pass filtering the multiplied summation signal.

10. The method as claimed in claim 3, wherein the step of detecting the microwave component of the summation signal comprises multiplying the summation signal by a microwave detection signal, multiplying the summation signal by the microwave detection signal phase shifted by $\pi/2$, and low pass filtering the multiplied summation signal.

11. The method as claimed in claim 4, wherein the step of detecting the microwave component of the summation signal comprises multiplying the summation signal by a microwave detection signal multiplying the summation signal by the microwave detection signal phase shifted by $\pi/2$, and low pass filtering the multiplied summation signal.

12. A device for focusing, on at least one point to be examined of a source of microwave radiation, antenna elements of an antenna array, each of which receives the radiation from the point with a respective reception phase shift comprising:

means for generating a low frequency modulation signal, means for phase shifting the low frequency modulation signal by phase shifts corresponding to the phase shifts of signals from said radiation source delivered by each of said antenna elements, and for delivering low frequency phase shifted modulation signals, means for amplitude modulating the signals delivered by each of the antenna elements by respective low frequency phase shifted modulation signals, means for adding the amplitude modulated signals together, to deliver a summation signal, means for detecting the microwave component of the summation signal and delivering a detected signal, and means for demodulating the detected signal.

13. The device as claimed in claim 12, wherein said means for amplitude modulating the signals delivered by the antenna elements comprise microwave switches.

14. The device as claimed in claim 12, wherein said means for demodulating the detected signal comprises:

means for phase shifting said low frequency modulation signal by an angle equal to $\pi/2$, means for multiplying the detected signal by the low frequency modulation signal and by the phase shifted low frequency modulation signal, and means for filtering the low frequency components of the multiplied detected signal.

15. The device as claimed in claim 13, wherein said means for demodulating the detected signal comprises:

means for phase shifting said low frequency modulation signal by an angle equal to $\pi/2$, means for multiplying the detected signal by the low frequency modulation signal and by the phase shifted low frequency modulation signal, and means for filtering the low frequency components of the multiplied detected signal.

16. The device as claimed in claim 12, wherein said means for detecting the microwave component of the summation signal comprises:

means for generating a microwave detection signal, means for phase shifting said microwave detection signal by an angle equal to $\pi/2$, means for multiplying the summation signal by the microwave detection signal and by the phase shifted microwave detection signal and for filtering the low frequency components from said multiplied summation signal.

17. The device as claimed in claim 13, wherein said means for detecting the microwave component of the summation signal comprises:

means for generating a microwave detection signal, means for phase shifting said microwave detection signal by an angle equal to $\pi/2$, means for multiplying the summation signal by the microwave detection signal and by the phase shifted microwave detection signal and for filtering the low frequency components from said multiplied summation signal.

18. The device as claimed in claim 14, wherein said means for detecting the microwave component of the summation signal comprises:

means for generating a microwave detection signal, means for phase shifting said microwave detection signal by an angle equal to $\pi/2$, means for multiplying the summation signal by the microwave detection signal and by the phase shifted microwave detection signal and for filtering the low frequency components from said multiplied summation signal.

19. A method of focusing, on at least one point to be examined of an object illuminated by microwave radiation, first antenna elements of a first antenna array transmitting the radiation towards the point with respective transmission phase shifts, at least one second antenna element receiving the radiation from said point, comprising the steps of:

generating a microwave transmission signal, generating a first low frequency modulation signal and applying a plurality of phase shifts thereto to produce a plurality of phase shifted first low frequency modulation signals, each phase shift corresponding to a respective transmission phase shift, amplitude modulating the microwave transmission signal with said plurality of phase shifted first low frequency modulation signals and applying the modulated signals so produced to respective first individual antenna elements, detecting the microwave component of a signal received by the at least said one second antenna element receiving radiation from the point, and demodulating the detected signal.

20. The method as claimed in claim 19, wherein a plurality of second antenna elements receiving radiation from said point are provided and arranged so as to form a second antenna array, each second antenna element of said second array receiving radiation from the point with respective reception phase shifts, said method further comprising the steps of:

amplitude modulating the signals delivered by the second antenna elements by at least a second low frequency modulation signal having, for each said second antenna element, a phase shift corresponding to a reception phase shift for that element, adding the modulated signals into a summation signal and detecting the microwave component of the summation signal.

21. The method as claimed in claim 20 further comprising the step of demodulating the detected signal by multiplying it by at least one signal at the beat frequency, between the frequency of the first low frequency modulation signal and the frequency of the second low frequency modulation signal.

* * * * *